United States Patent [19]

Cadwallader et al.

[11] 4,194,487

[45] Mar. 25, 1980

[54] DOWNDRAFT WOODBURNING STOVE

[76] Inventors: John Y. Cadwallader, Sycamoore La., West Arlington, Vt. 05250; Edward J. Frasier, 307 Elm St., Bennington, Vt. 05201

[21] Appl. No.: 711,065

[22] Filed: Aug. 2, 1976

[51] Int. Cl.[2] ..... F24B 7/04

[52] U.S. Cl. ..... 126/61; 126/76; 126/77

[58] Field of Search ..... 126/60, 61, 64–69, 126/72, 75–77, 103, 73, 74; 110/84

[56] References Cited

U.S. PATENT DOCUMENTS

| | | | |
|---|---|---|---|
| Re. 11,623 | 7/1897 | McLean | 126/76 X |
| 661,257 | 11/1900 | Brooke | 126/75 X |
| 2,190,343 | 2/1940 | Town | 126/75 |
| 2,374,707 | 5/1945 | Sharpe | 126/103 X |
| 2,475,120 | 7/1949 | Young | 126/72 |
| 2,797,874 | 7/1957 | Harding | 126/65 X |
| 2,883,947 | 4/1959 | Corey | 110/84 X |
| 3,171,399 | 3/1965 | Kirgan | 126/75 X |

FOREIGN PATENT DOCUMENTS

| | | | |
|---|---|---|---|
| 126936 | 12/1949 | Sweden | 126/73 |

*Primary Examiner*—William E. Wayner
*Assistant Examiner*—William E. Tapolcai, Jr.
*Attorney, Agent, or Firm*—E. Seward Stevens

[57] ABSTRACT

A downdraft woodburning stove in which there is improved combustion, heat transfer and combustion regulation comprising novel air inlet circulation, grate construction and automatic control of (1) temperature of exhaust gases and (2) of combustion air, and (3) the supplies of both primary and secondary air to a plurality of combustion areas.

4 Claims, 10 Drawing Figures

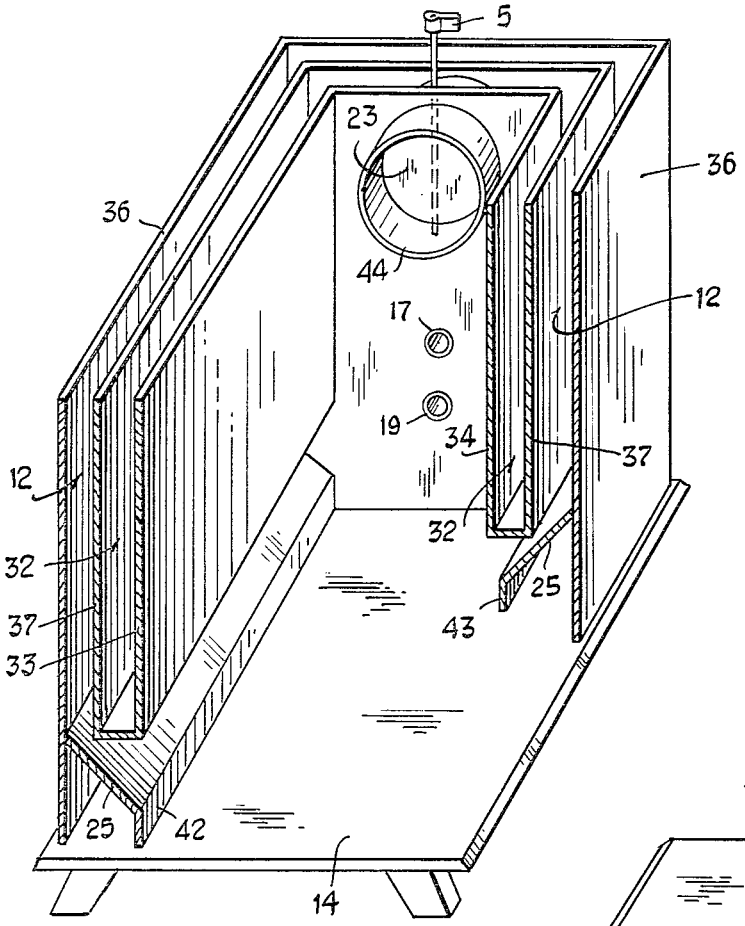
Fig. 8
Fig. 9
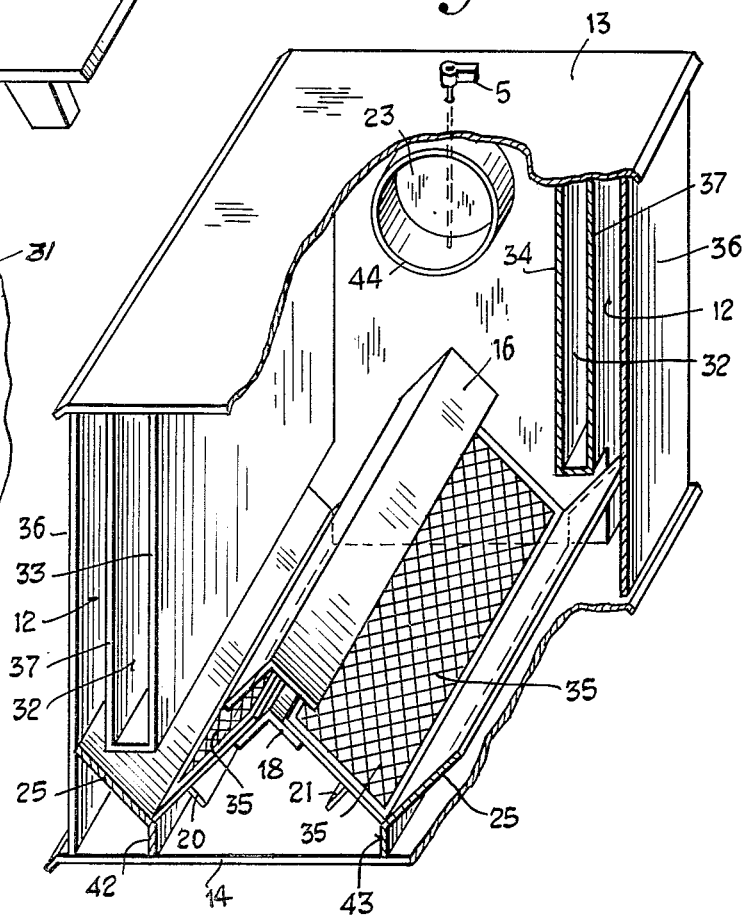
Fig. 10
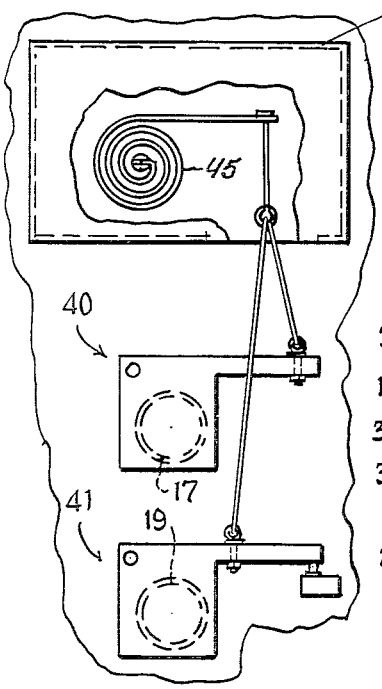

DOWNDRAFT WOODBURNING STOVE

OBJECTS

To provide a downdraft woodstove of superior efficiency in combustion, heat transfer and control through a stove comprising distinct combustion zones, grate construction, air supply and air control to attain maximum efficiency in combustion and heat transfers.

PRIOR ART

"Downdraft" stoves are known in the prior art but same are less efficient than applicants' due to failure to provide additional air to exhaust gasses prior to final combustion, failure to mix same, inadequate source of ignition for air/gas mixture, failure to retard generation of combustible gasses from an undesirable high rate and failure to divide the stove into distinct zones in which different phases of combustion can occur.

The following prior art patents have been considered: U.S. Pat. Nos. 719,827, 1,368,405, 1,954,923, 2,075,485, 2,190,343, 2,337,847, 2,461,068, 2,569,781, 2,575,860, 3,171,399, 3,219,024, 3,874,362,

DEFINITIONS

Terms common to the prior art and used herein are:

Primary Combustion—meaning—the normal wood fire with a bed of coals being fed by fresh fuel from above which fire releases smoke including combustible gases.

Primary Air—Meaning air supplied to the zone of primary combustion.

Secondary Combustion—meaning the burning of gases and smoke given off by primary combustion.

Secondary Air—meaning air supplied to and mixed with the combustible gases in order to provide the oxygen required for secondary combustion.

THE DRAWINGS

A practical embodiment of our invention is illustrated in the accompanying drawings in which:

FIG. 8 is a partial perspective, partially in section and partially broken away, viewed from the front and top, the top, front, grate angles and part of the right side being removed.

FIG. 9 is a partial perspective, partially in section and partially broken away, the front and part of the right side being removed, and FIG. 10 is a rear view of the stove illustrating the thermostatic control of the dampers and blower switch.

Figure 1:
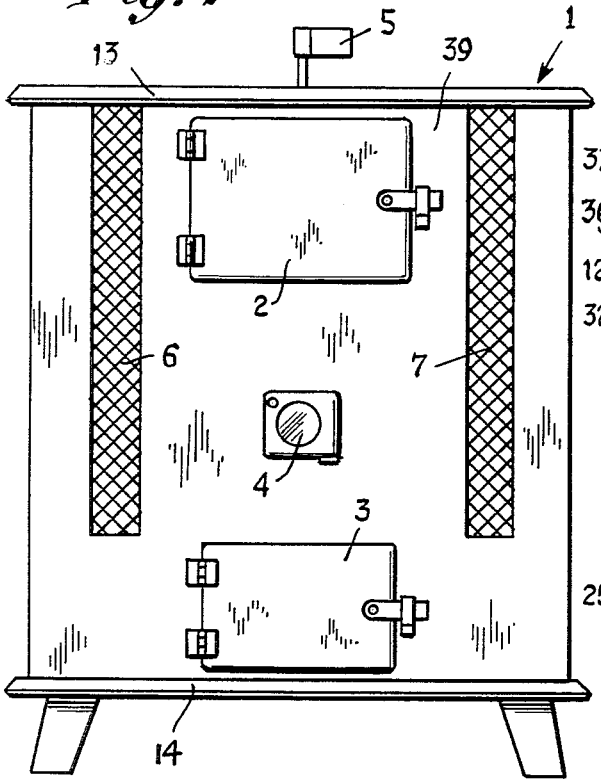
FIG. 1 represents a front view of a stove embodying the invention.

A stove body which may be cylindrical, oblong or other predetermined shape, is shown in the several figures as 1 and provided with a top 13, a front door 2, a bottom front door 3 and a bottom 14. Located between the doors 2 and 3 is a sight port 4. A handle 5 is provided for operating the internal by-pass damper 23. Two grill-work coverings 6 and 7 are located at both sides of doors 2 and 3 for warmed air exits.

The stove interior is divided into six distinct zones designated generally by the numerals 8, 9, 10, 11, 12 and 32. These zones function respectively as fuel storage space 8; primary combustion zones 9—9; air and gas mixing zone 10; secondary combustion zones 11—11; secondary combustion completion zones 12—12 and heat exchange zones 32—32. Shells 15 encompasses zones 32.

More specifically defined, the several zones are bounded as follows;

Zone 8 is covered by top 13, has its bottom determined by element 16 which extends, longitudinally, the length of zone 8, the walls of which, denoted as 33 and 34, form the inner walls of zones 32—32. Communication with other zones 9, 9 occurs along the lower edges of walls 33 and 34. Rear wall **38*a* and stove front 39 encompass other rear walls 38*b* and 38**.

Zone 9—9 is established by the lower sections of walls 33-34, the grates 35,35 and a second element 18 all located between the stove ends as are the zones described below.

Below the said grates 35, 35 and above stove bottom 14 and topped by the said element 18 is the mixing zone 10.

The secondary combustion starting zones 11—11 lie in a plane generally lower than zones 9—9 but adjacent thereto, the lower sections of zones 11—11 being defined by angled solid piece 25 extending longitudinally of the stove.

The secondary combustion completion zone 12 lies between the stove side wall 36, 36, stovetop 13, inner stove walls 37, 37 and rear stovewall **38*a* plus front wall 39**.

Heat exchange zones 32,32 lie between the secondary combustion completion zone 12 and the fuel storage space 8 and are provided for the circulation of room air therethrough either by natural convection or means for circulating same as desired.

Below the V-shaped element 16 is a pipe or nozzle 17 open at both ends and extending from the inside of the stove to the outside rear and having a damper 40 mounted on the outside end to control admission of primary air below element 16.

Under pipe 17 is the second element 18 which runs the length of zone 10. Secondary air is admitted under element 18 through pipe or nozzle 19, same being similar in construction to pipe 17 and having its damper 41 to control air flow to zone 10, the mixing zone and, thence, to zone 11 the secondary combustion zone.

A pair of grates 35, 35 slanted to the angle of element 18 and supported thereby are supported by the element 18 and vertical elements 42,43 arising from the stove bottom.

Element 16, air inlet pipe 17 and damper 40 may be omitted. A portion of the combustion air entering through pipe 19 will enter zones 9 by passing upward through the upper portions of the grates 35. Said portion of air will supply primary air to zones 9 in a manner equivalent to air entering through pipe 17. With or without element 16, pipe 17 and damper 40, that portion of air entering through pipe 19 and passing upward through the lower section of grates 35 will provide secondary air to zones 11 and 12.

Solid baffles 20, 21 are angled inwardly from and run the full length of grates 35 to prevent or hinder smoke and combustible gases from passing directly between upper and lower grate sections. The lower grate sections run the full length of zones 10 and 11 and retain coals in zone 11 at the lower portion thereof while permitting smoke and combustible gases to flow from zone 10 to zone 11.

A damper 23 is positioned in flue 44 so that when "open" the stove will function in "updraft" manner, i.e., smoke and gases will flow upward through zone 8 and directly into the flue 44. When the damper is "closed" the stove will operate in "downdraft" mode and smoke and gases must flow down through Zones 9, 10 and 11 then up through zone 12 and eventually be exhausted through the rear flue 24.

Figure 4:
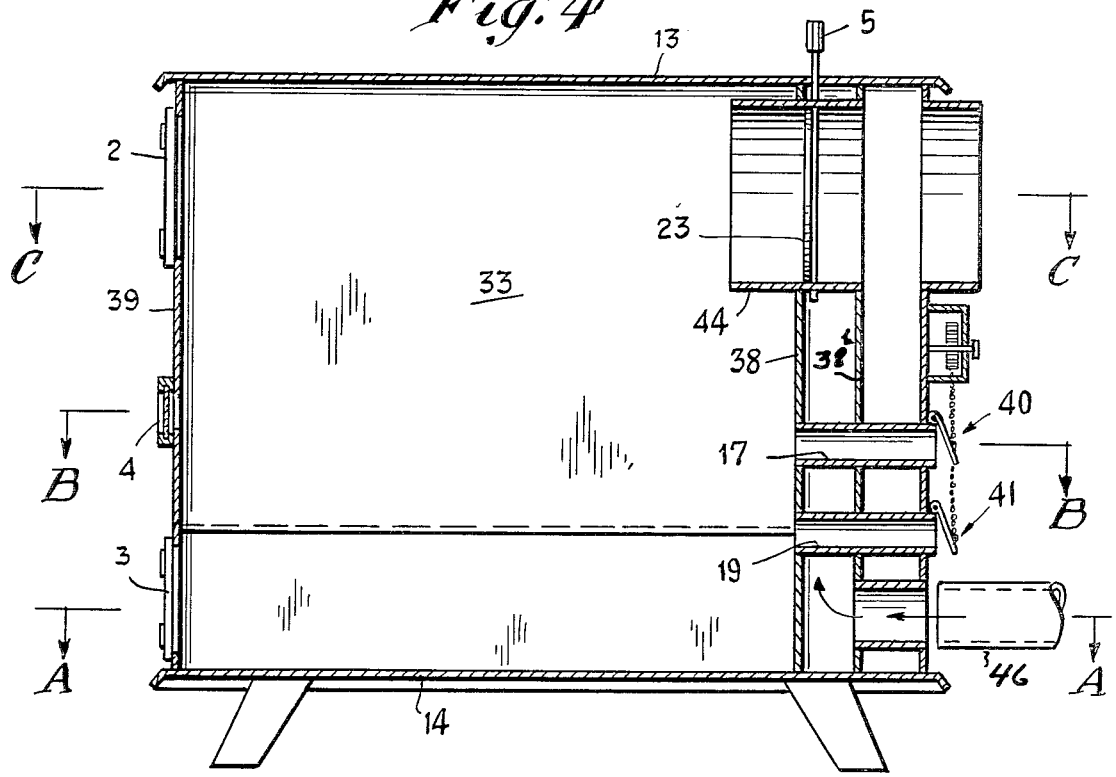
FIG. 4 is a side elevation of the form shown in FIG. 1, partially in section.
Figure 5:
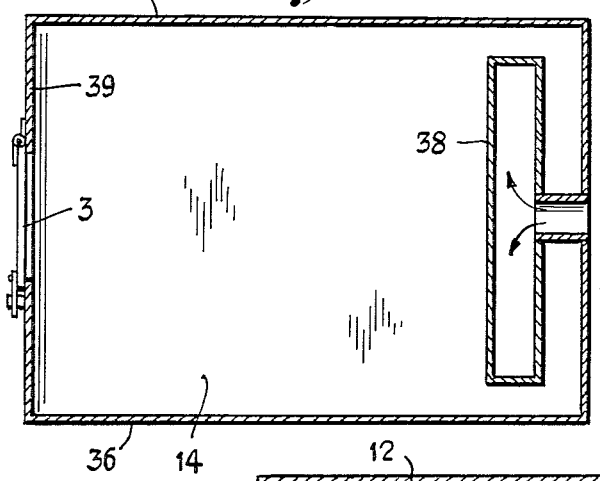
FIG. 5 is a horizontal section taken on line A—A of FIG. 4, looking in the direction of the arrows with certain parts omitted for clarity of illustration.
Figure 6:
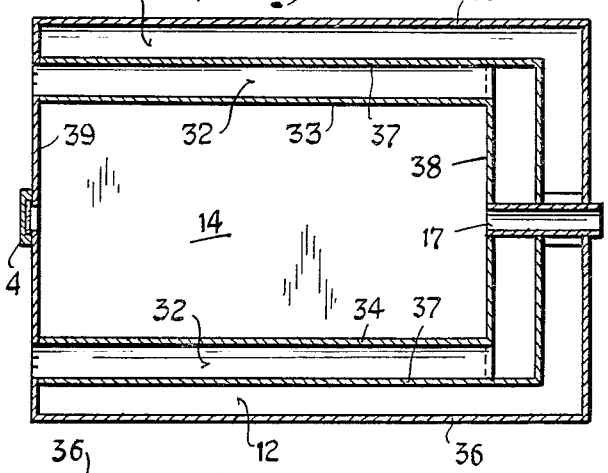
FIG. 6 is a horizontal section taken on the line B—B of FIG. 4, looking in the direction of the arrows.
Figure 7:
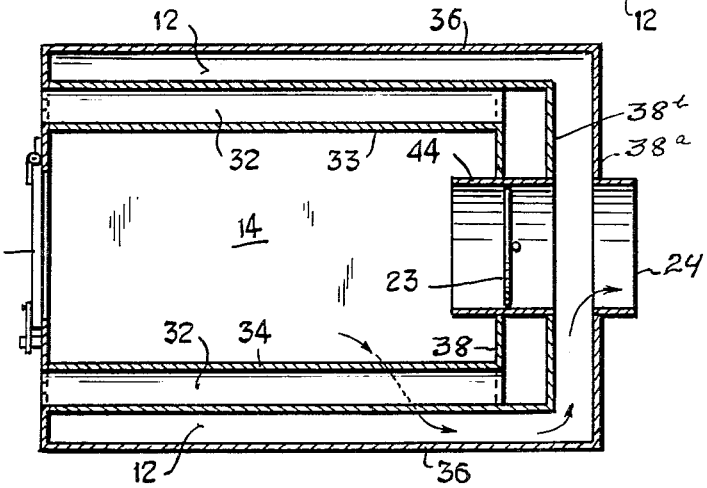
FIG. 7 is a horizontal section taken on the line C—C of FIG. 4, looking in the direction of the arrows.

A thermostatic controller denoted by 31, see FIGS. 10 and 4, utilizes a bimetallic coil 45 and is so located as to sense exhaust gas temperature and operate dampers 40 and 41 on nozzles 17 and 19 to regulate the flow of air therethrough. If desired connection can also be made to operate the blower switch (See FIGS. 4 and 10). Any well known or approved blower can be used to supply air to and through a pipe 46 (See FIGS. 4 and 5) at the rear of the stove. The pipe is not attached to the stove so that when the blower is "off", natural convection will draw air into the stove.

OPERATION

To start the stove, damper 23 must be open as well as the port 4, together with nozzles 17 and 19, so the stove will operate in the "updraft" mode.

A small amount of suitable starting material and fuel is loaded in zone 8, ignited and permitted to burn down to coals before adding a large charge of fuel or switching to the "downdraft" mode.

Figure 2:
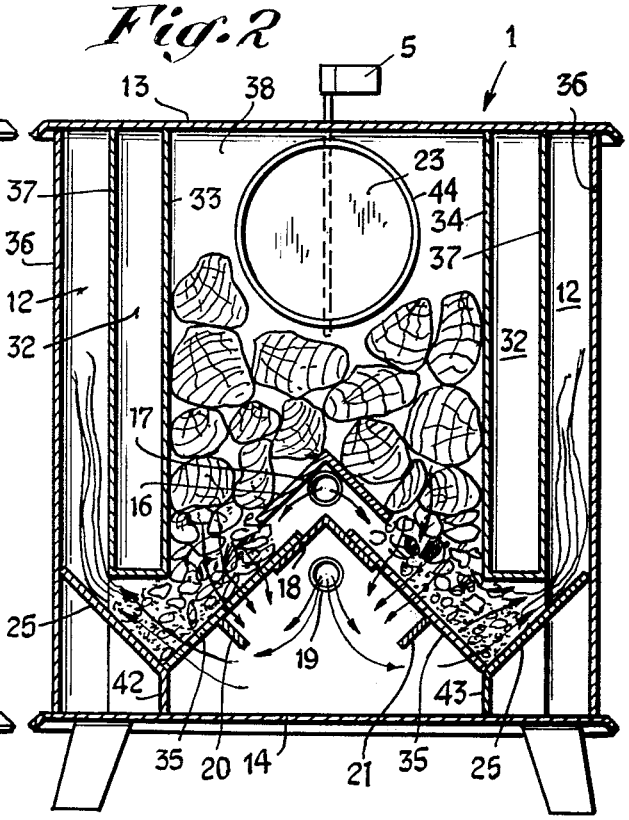
FIG. 2 represents a front view of the embodiment shown in FIG. 1 with the front removed to show the stove loaded and operating in a "downdraft" manner.
Figure 3:
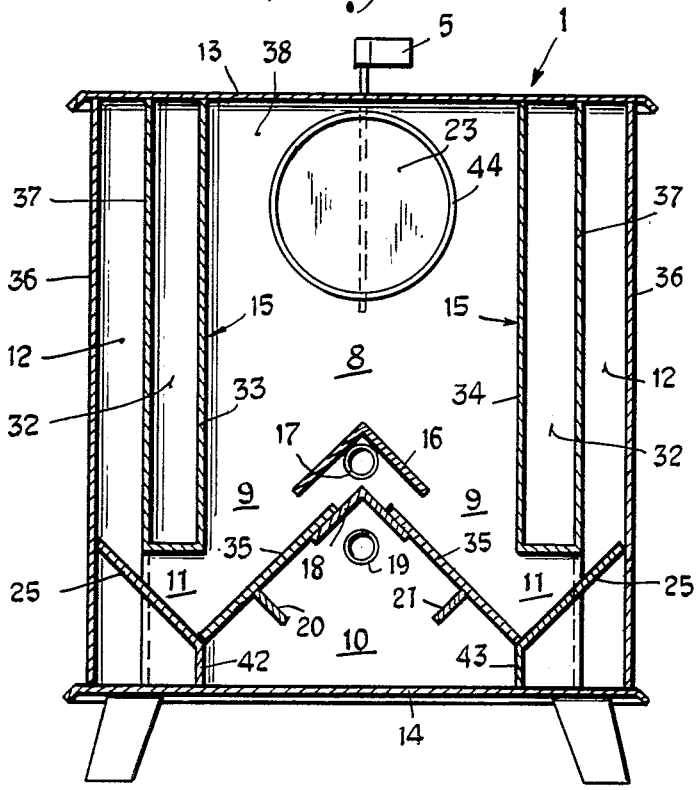
FIG. 3 is a view similar to that of FIG. 2 showing the stove empty.

Once a bed of coals has been established in zones 11 and 9, the stove can be fully loaded in zone 8 and switched to "downdraft" operation by closing damper 23. This condition is shown in FIG. 2. Inlet air from pipe 17 or pipe 19 meets fuel from zone 8 in zone 9 and primary combustion occurs. A further function of the inlet air is to keep the inverted V-shaped element 16, cooled and the latter also aids to shield the additional fuel from the heat of the primary combustion zone 9 in zone 8. The major portions of smoke and combustible gases pass through grate 35 into zone 10 while some coals pass from zone 9 into zone 11. The amount of smoke and combustible gases taking the desired route of flow from the primary combustion chamber on zone 9 through zones 10 and 11 is determined by the spacing of the lower sections of grate 35—35 from the lower sections of walls 33 and 34. Some smoke and combustible gas mix with additional air admitted through nozzle 19 and pass through grates 35 where they are ignited by the coal beds as they pass through zone 11. The additional air serves also to supply oxygen to the coal bed to maintain combustion. The last named smoke and gas combustion is finished in zone 12, which is provided with outlet flue 24 being the outer end of flue 44. As previously noted the temperature of the flue is sensed by the bimetallic coil 45 which controls dampers 40 and 41 as well as a blower switch to automatically regulate air supply to the stove operation.

Equivalents of our invention include interchanged zones 12 and 32; relocating the heat exchange chamber and blower externally and/or changing the grate design by relocation of its openings, changing the sizes of same or making element 35 solid as an extension of piece 18 and adding a grate slanted across the lower section of zone 11.

Other changes may be incorporated in our structure without departing from the spirit and scope of our invention as set forth in the appended claims.

What we claim is:

1. A downdraft stove comprising a stove body within which are one or more slanting grates with means for supporting same in said body and also within which are internal members of one or more walls extending upwards from a point above the lowest point of said slanting grates so as to form a space between said members and grates with at least one air inlet nozzle below said grates, one or more air inlet nozzles above said grates and longitudinal elements above said nozzles to provide a clear passageway for combustion air whereby progressively burning coals descend to said space and whereby all smoke, air and gases pass through said space insuring their complete ignition.

2. The combination according to claim 1 with a single air inlet nozzle below said grates and with a single longitudinal element above said nozzle to provide a clear passageway for combustion air.

3. The combination according to claim 1 wherein the space between said internal members and the outer walls of said stove body comprises an exhaust gas chamber which extends down both sides and around the rear of said stove body and connects to a flue at the rear through which burnt gases are exhausted.

4. The combination according to claim 1 wherein said internal members are comprised of two or more walls joined so as to form a heat exchange chamber the air inside of which will be totally isolated from combustion air and which can be connected to a suitable blower or which can be provided with openings for passage of air by natural convection.

* * * * *